US005819761A

United States Patent [19]

Sloan

[11] Patent Number: 5,819,761

[45] Date of Patent: Oct. 13, 1998

[54] HAIR-BRAIDING DEVICE AND METHOD FOR ITS USE

[76] Inventor: Karlye M. Sloan, 11620 SW. Burlcrest Dr., Tigard, Oreg. 97223

[21] Appl. No.: 735,964

[22] Filed: Oct. 23, 1996

[51] Int. Cl.[6] ..... A45D 7/00; A45D 2/12

[52] U.S. Cl. ..... 132/210; 132/226; 132/273

[58] Field of Search ..... 132/207, 210, 132/273, 276, 280, 284, 245, 226, 238, 237

[56] References Cited

U.S. PATENT DOCUMENTS

| | | | |
|---|---|---|---|
| D. 123,597 | 11/1940 | Izquierdo . | |
| 2,318,972 | 5/1943 | Simas | 132/226 |
| 2,655,926 | 10/1953 | Parrilla | 132/226 |
| 3,930,511 | 1/1976 | Roney | 132/284 |
| 5,119,847 | 6/1992 | Powell et al. . | |
| 5,228,465 | 7/1993 | Hill | 132/273 |
| 5,240,017 | 8/1993 | Terwilliger . | |
| 5,275,182 | 1/1994 | Northcutt . | |
| 5,323,793 | 6/1994 | Lorenzi . | |
| 5,464,030 | 11/1995 | Avellanet . | |

FOREIGN PATENT DOCUMENTS

| | | | |
|---|---|---|---|
| 661618 | 11/1951 | United Kingdom | 132/245 |

*Primary Examiner*—Todd E. Manahan
*Attorney, Agent, or Firm*—Kolisch, Hartwell, Dickinson, McCormack & Heuser

[57] ABSTRACT

A hair-braiding device and method for its use are described. The invented device includes a flat, elongate body having at least one opposing pair of preferably slotted openings extending inwardly from either end, the openings being lined with a resilient but yieldable, preferably foam material that permits hair strands to be introduced alternately thereinto and tensions the semi-captured strands as the device is twisted or rotated to impart a two-braid between the strands. Preferably, the body is formed of a molded polymer and the foam is a continuous strip of material that, within either slot, extends along one edge and folds back to extend along an opposing edge of each slot. The device is easily held in one hand, with the other hand free to introduce alternate strands into either slotted end of the device as the device is rotated each time. The device progressively is urged downwardly with each step, as the tensioned strands of hair controllably slide between the opposing foam linings, which substantially close their respective slotted openings. Preferably, the slots extend inwardly arcuately from a tapered throat at the extreme ends of the device, and preferably extend along the long axis of the device more than half-way through its length. The result of using the device, as described briefly above, is a properly tensioned, relatively stray-free, attractive French roll braid.

14 Claims, 2 Drawing Sheets

HAIR-BRAIDING DEVICE AND METHOD FOR ITS USE

TECHNICAL FIELD

The present invention relates generally to hair braiding. More particularly, it concerns an improved braiding device and method for its use that when manipulated produces a two-braid (rope-braid) that is evenly tensioned and attractive.

BACKGROUND ART

Conventionally, two-braiding—by which two strand masses of hair are twisted around one another and tightened into an attractive, cascading hairdo—is done manually, without the benefit of tools or braiding devices. The biggest problem in two-braiding, especially with thick or voluminous hair, is maintaining the proper tension in the two hair strands, which tensioning typically is imparted by attempting to capture the hair masses between the fingers of either hand while manipulating, e.g. twisting, the masses about one another. Another problem especially when braiding one's own hair, is maintaining both strands separated from each other while picking up and including further hair strands. U.S. Pat. No. 5,464,030 to Avellanet entitled TWIST HAIRDO ROLLER discloses a pliable, two-ended device including wrapping structure in a central region thereof and combs on either end. A ribbed foam rubber sleeve surrounds the pliable device, and is said to help retain the hair in the twist hairdo by frictional engagement against the wrapping structure. The patent disclosure does not suggest open slotted ends having tensioning means therein for holding strands of hair or a one-handed grippable and twistable rigid body to assist in hair-braiding.

DISCLOSURE OF THE INVENTION

Briefly, the invented device includes a flat, elongate body having openings extending inwardly from either end, the openings possessing linings with a resilient but yieldable foam material that permits hair strands to be introduced alternately thereinto and tensions the semi-captured strands as the device is twisted or rotated to impart a two-braid between the strands. Preferably, the body is formed of a molded polymer and the lining is a continuous strip of material that, within either opening, extends along one edge and folds back to extend along an opposing edge of each opening. The device is easily held in one hand, with the other hand free to introduce strands from either side of the braid's seam into either slotted end of the device as the device is rotated each time. The device progressively is urged downwardly with each step, as the tensioned strands of hair controllably slide between the opposing foam linings, which substantially close their respective slotted openings. Preferably, the openings extend inwardly arcuately from a tapered throat at the extreme ends of the device, and preferably extend along the long axis of the device more than half-way through its length. The result of using the device is a properly tensioned, relatively stray-free, attractive braid.

These and additional objects and advantages of the present invention will be more readily understood after consideration of the drawings and the detailed description of the preferred embodiment which follows.

Figure 1:
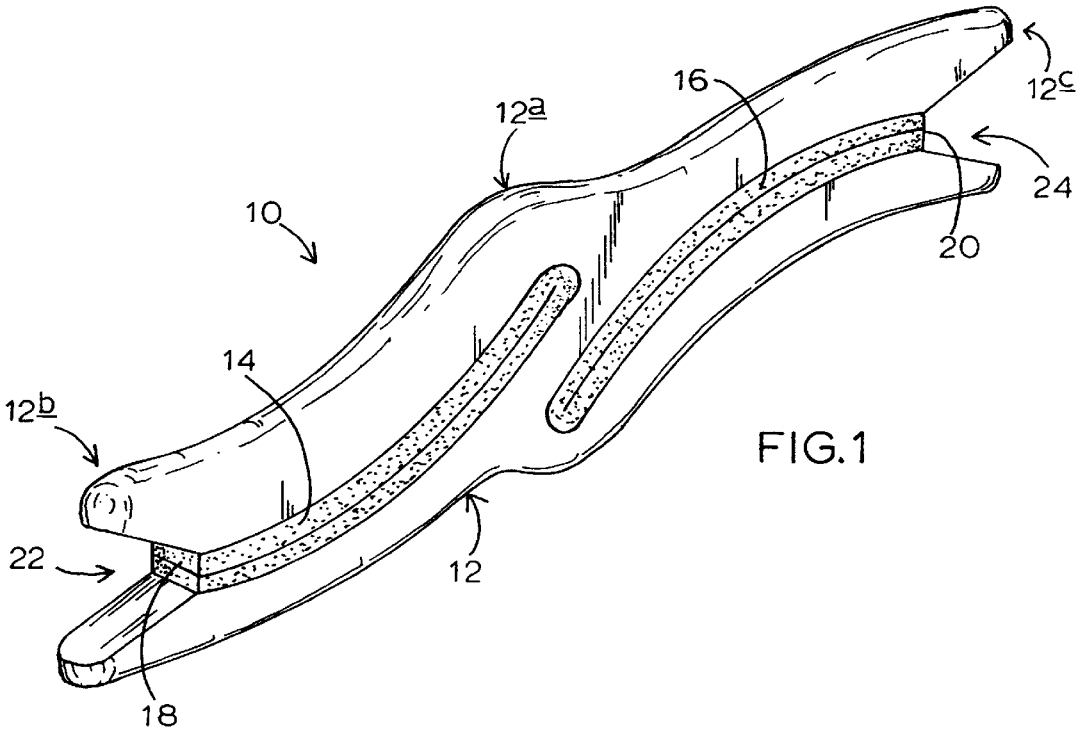
FIG. 1 is an isometric view of the invented device made in accordance with its preferred embodiment.
Figure 2:
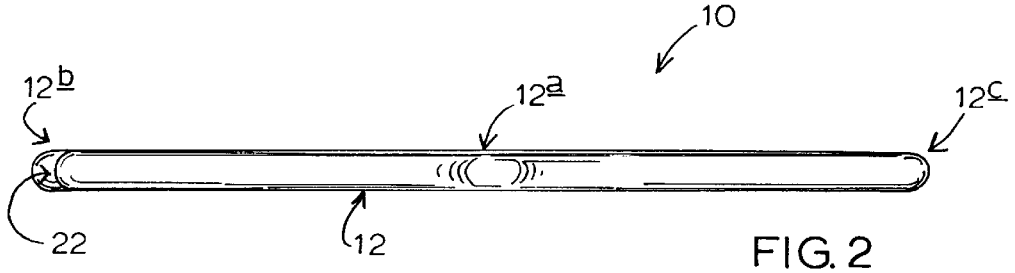
FIG. 2 is a top plan view of the device.
Figure 3:
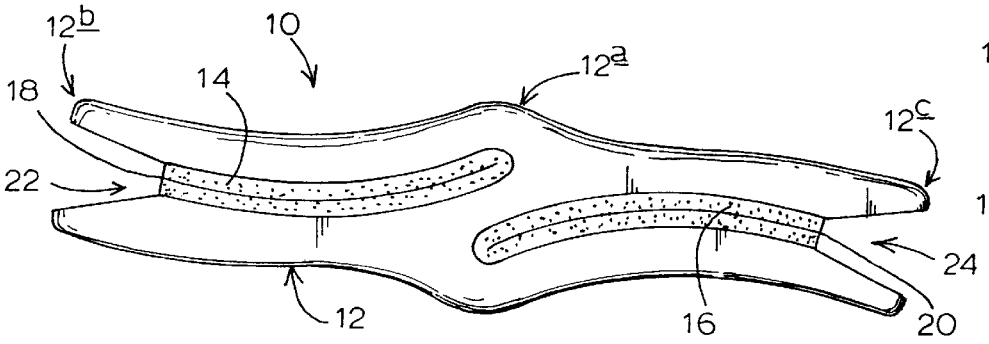
FIG. 3 is front elevation of the invented device.
Figure 4:
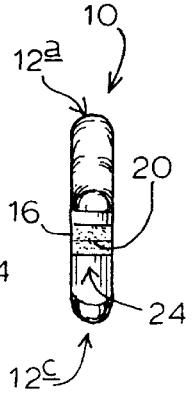
FIG. 4 is a an end view of the device made in accordance with its preferred embodiment.

DETAILED DESCRIPTION OF THE PREFERRED EMBODIMENT AND BEST MODE OF CARRYING OUT THE INVENTION

Referring collectively to FIGS. 1 through 4, the invention may be seen to be very straightforward. Hair-braiding device 10 is a hand-held device for use by hairdressers or others to assist in two-braiding (rope-braiding) long hair. The device is depicted in isometric view in FIG. 1, in top plan view in FIG. 2, in a front elevation in FIG. 3 and in an end elevation in FIG. 4. Thus, it will be appreciated that bottom plan, rear and other end elevations are similar, e.g. left-to-right or top-to-bottom mirror images, but are not shown for the sake of brevity.

Device 10 may be seen to be generally symmetric end-to-end, and to have a rigid body 12. The openings 18, 20 are each filled with a lining 14, 16 which is a malleable material such as foam. Body 12 includes a central body region 12*a* that is easily graspable in one's palm or by extending the index and middle fingers on either far side thereof and the thumb on either near side thereof. Body 12 also preferably has, extending inwardly from either of two end regions indicated generally at 12*b*, 12*c* at least a pair of opposing, i.e. at least two opposing, preferably arcuate, elongate slotted openings 18, 20 for the introduction of strands of hair thereinto from either extreme terminal end of device 10. Although another embodiment may possess openings 18, 20 which are of another shape such as circular, triangular, oval, etc. Preferably, end regions 12*b*, 12*c* include tapered throats, or opposing guide surface pairs, 22, 24 that form opposing V-shaped openings that are adjacent and operatively connected with openings 18, 20, respectively. As may be seen, openings 18, 20 preferably extend inwardly in opposing arcuate curves that extend substantially half-way, and preferably more than half way, through the length of body 12.

Opposing pair of openings 18, 20 extending inwardly from either end of the device preferably are cushioned, as shown, by linings 14, 16 extending along the interior, and on either edge, thereof. In accordance with the preferred embodiment of the invention, the lining 14 substantially fills the openings 18, 20 from a single strip of foam that is folded back on itself, as shown, to extend along either side of the entire length of each of the openings' opposed edges or interior surfaces. Linings 14, 16 are dimensioned nominally or substantially to close each of openings 18, 20 to produce a yieldable region into which hair may be introduced as described above, and may be affixed to body 12 by any suitably durable technique such as an adhesive. In the preferred embodiment of the invention the lining is grasped with plural, tiny, sharp prongs or hooks (not shown for sake of clarity) protruding from the openings 18, 20 of the body 12.

Referring still collectively to FIGS. 1 through 4, it will be understood that body 12 may be made of any suitable material such as a molded polymer to produce a lightweight hard rigid body and that the linings 14, 16 may be made of any suitable material such as a molded or extruded foam polymer or other malleable but resilient (temporarily deformable, yet indefinitely shape-retentive) material. Preferably, the body may be approximately 5–8" long, approximately 1¾" in its widest central region and approximately ⅜–½" thick. Each opening such as the pair of slotted openings made in accordance with the preferred embodiment of the invention may be approximately 3" deep and approximately ¼–⅜" wide. Of course, within the spirit and scope of the invention, other dimensions and materials may be used. Each end region 12*b*, 12*c* of body 12 preferably includes a tapered throat such as tapered throats 22, 24 for easy introduction of hair into openings 18, 20.

Those of skill in the art will appreciate that tensioning of the hair is very important in producing a comfortable, even-looking braid. Importantly, it is believed that the oppositely arcing curved slotted openings accommodate more hair than would linear slotted openings in the same size device (because of the increased depth or length of a curved slotted opening over a straight one of equal span), and also that the curved slotted openings provide smoother and more constant tensioning of the hair as the device is twisted, perhaps by imparting a slight twist to each strand as it is fitted therewithin, as new strands of hair optionally are inserted alternately on either side and as the device is progressively slid down the person's hair in accordance with the invented hair-braiding method to be described in detail by reference to FIGS. 5A through 5E. Those of skill in the art will appreciate, however, that straight or other shapes and configurations of openings or hair strand-collecting and tensioning means are within the spirit and scope of the invention.

The invention thus may be described as a hair braiding device including a rigid elongate body portion 12 including openings 18, 20 on either end extending inwardly therefrom. Preferably, there is, filling each opening, a flexible lining 14, 16 extending inwardly and oppositely from either edge of the opening substantially yieldably to close the opening, with the lining tensioning hair that is extendable through the opening at substantially right angles thereto. Preferably, the body portion is hand grippable or graspable by a user for alternately extending hair for braiding into either of the openings, the body portion further being twistable between such extensions, also manually and most preferably using one hand so that the other is free to introduce hair strands into the opening on either end of the device, as will be further described below in terms of the preferred method of the use of device 10.

Method of Use of the Invented Device

Device 10 is held generally horizontally oriented with one hand flat against or near the head, e.g. the crown, of the person whose hair is being braided, and half of the hair to be two-braided (rope-braided) is fed through one of the openings so that it cascades down the person's back. The other half of the hair to be braided similarly is fed through the other of the openings. Device 10 is then twisted, or rotated about its center, within the plane in which it lies, preferably through approximately 180°.

The coiffure progressively pushes the device down and the hair under controlling tension, as it is pinched within the openings, slides therethrough. The process is repeated, with additional or loose strands of hair from either side being preferably alternately inserted also into the openings on either end of the device, and with the 180° rotation continuing until the end of the hair's length is reached. The invented hair-braiding process is illustrated in FIGS. 5A through 5D. Those of skill in the art will appreciate that device 10 may be rotated, between introductions of new hair strands, more than 180°, e.g. 360° or 540°, to produce different, equally pleasing braided results.

Figure 5A:
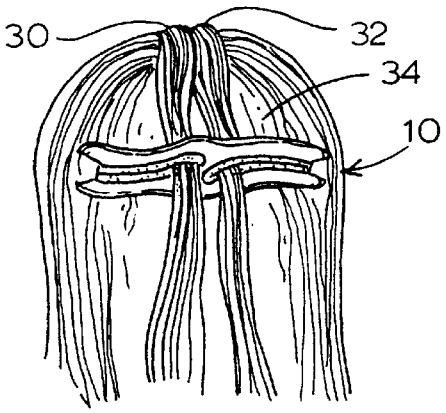
FIGS. 5A through 5E illustrate the method of using the invented device to two-braid hair, as a series of steps.

In FIG. 5A, device 10 may be seen to be generally horizontally oriented and to be engaging a person's hair strands extending through the openings on either end of the device's rigid body and between the tension-supplying foam lining therein. Importantly, it is seen that the tensioning supplied by the foam-lined opening holds the device in place against the crown of the person's hair without being held in place, while neatly arranging and separating each strand of hair in a highly controlled fashion.

This feature of the invention is extremely advantageous in that the hair-braiding process may be interrupted and returned to without adverse impact on the quality of the ultimate braided hairdo. With the many interruptions that typically occur during the coifing of a given client, e.g. to perform next steps on the hairdos of other clients or simply to turn away from the present braiding client to answer a question or glance at another client, hairdressers using the invented device and method need not worry whether the braid will turn out properly tensioned and attractive. In addition, when persons are braiding their own hair, the invention provides more control over retaining the braided strands while adding additional strands.

Figure 5B:
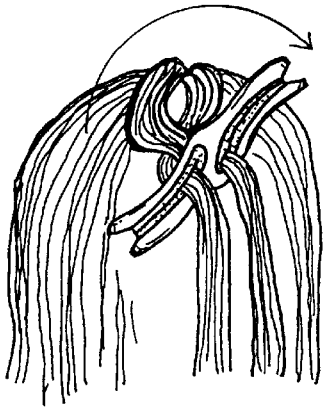

FIG. 5B shows the person's hair after the invented device having hair strands extending therethrough has been partway twisted, or rotated approximately 60°. It may be seen from FIG. 5B how the strands of hair from either side of the person's hair are introduced into openings on either end of the device's body and the body by grasping the same in the palm of either hand easily and accurately may be rotated as the device is pulled gently downwardly, thereby properly to tension the hair slidingly captured within the openings.

Figure 5C:
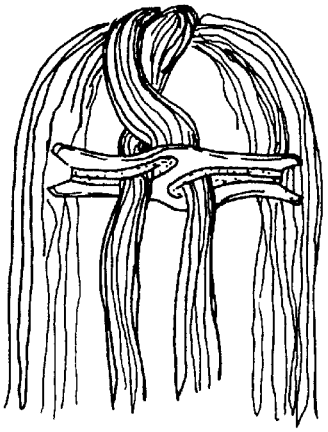

FIG. 5C shows the person's hair after the invented device having hair strands extending therethrough is fully twisted, or rotated 180° in accordance with the preferred method of use. The braiding of the person's hair may be seen to have been started, with a properly tensioned and attractive inwardly folded two-braid, or what some might refer to as a French roll braid, beginning to develop behind, or above, the device which still captures the strands of hair therein.

Figure 5D:
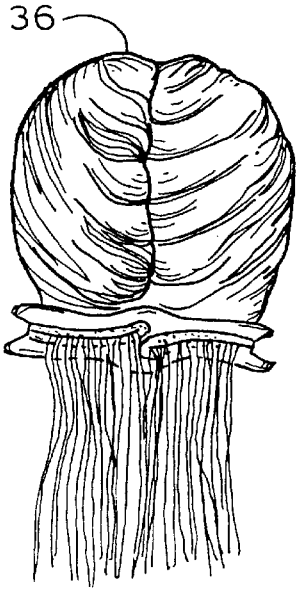

FIG. 5D shows the person's hair in a later stage of braiding after further strands have been added to either opening and after still further twists have been imparted. It is noted that, as the device is twisted or rotated at each step, any stray hairs may be dressed, and new strands of hairs may be added to the braid by simply introducing them into the openings on either end of the device to maintain a stray-free and growing twisted wrap of hair as the device is moved down the person's head. As the device is rotated, it also may be noted that the developing braid behind the device tends to urge the device downwardly, or to cause it to progressively move closer to the ends of the strands of hair. Downward force may be applied by the coiffure or other user, yet maintaining the tension in the captured hair strands by virtue of the lined slots that yieldably capture the growing volume of hair.

Figure 5E:
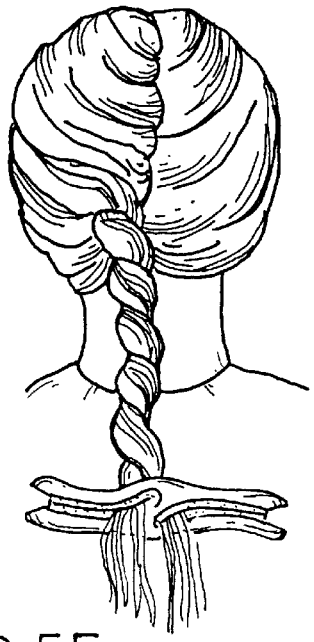

Finally, FIG. 5E shows the person's hair after further twists or rotations of the device have been imparted to the device and the to-be-braided hair. A neat and relatively stray-free two-braid, or rope-braid, may be seen to be nearly completely developed in the person's hair above or behind the device as it is progressively slid and rotated downwardly past the person's neck and high back, with a twisted braid developing substantially throughout the length of the person's hair. Those of skill in the art will appreciate that the device may be twisted more than once at each and any step, depending upon the desired tension in the braid and the desired ultimate aesthetic goal. It will be appreciated that the braid, when complete, may be secured against untwisting or unraveling by any suitable means, e.g. a clasp or band, as shown.

Thus, the invented method of use of device 10 may be understood preferably to include parting all or a region of a person's hair into at least two sections 30, 32, and then grasping and placing the hair braiding device 10, with one hand 38, at a point 34 on the person's head at which a braid 36 is to begin. The user then takes section 30 of hair opposite hand 38 grasping device 10 and inserts it into opening 18 of the hair braiding device which is filled with the lining 14 of malleable material. The lining 14 is compressed by the same area as that of the inserted hair section 30, thereby maintaining tension on the inserted hair section 30. The user grasps the hair braiding device 10 with the other hand 40 and takes other section of hair 32 and inserts it into other opening 20 of the device. The hair braiding device 10 may be rotated a desired number of times to roll the inserted sections of hair relative to one another. Additionally, after two sections of hair 30, 32 are retained and rotated by device 10, more sections may be added to repeat the grasping, inserting, and rotating steps. Braid 36 may be fixed to avoid unrolling by a clasp or band or any other means.

Accordingly, while the present invention has been shown and described with reference to the foregoing preferred device and method for its use, it will be apparent to those skilled in the art that other changes in form and detail may be made therein without departing from the spirit and scope of the invention as defined in the appended claims.

I claim:

1. A hair braiding device comprising:

a rigid body portion including at least one opening on either end with each of said openings possessing a tapered throat, each of said openings being filled with an opposing yieldable lining extending along a substantial length of said opening, each of said linings tensioning hair extendible through a corresponding one of said openings, said body portion being hand grippable by a user for alternately extending hair for braiding into either of said openings, said body portion being rotatable between such extensions.

2. The device of claim 1, wherein said rigid body portion is of a molded polymer.

3. The device of claim 1, wherein said lining is of a foam polymer.

4. The device of claim 1, wherein at least one of said slotted openings extends more than halfway along the length of said body portion.

5. The device of claim 1, wherein at least one of said slotted openings extends past the midpoint of said body portion.

6. The device of claim 1, wherein opposite pairs of said openings are slotted and curved in opposite arcs along approximately half of the length of said body portion.

7. A hair braiding device comprising:

a rigid body portion including at least one opening on either end with each of said openings possessing a tapered throat, wherein opposite pairs of said openings are slotted and curved in opposite arcs along approximately half of the length of said body portion, each of said openings being filled with a lining, each of said linings tensioning hair extendible through a corresponding one of said openings, said body portion being hand grippable by a user for alternately extending hair for braiding into either of said openings, said body portion being rotatable between such extensions.

8. The device of claim 7 wherein each of said slotted openings extends more than half way along the length of said body portion.

9. The device of claim 7, wherein said rigid body portion is of a molded polymer and wherein said openings are slotted, wherein said lining is of a foam polymer, wherein opposite pairs of said slotted openings are curved in opposite arcs along approximately half of the length of said body portion.

10. The device of claim 9, wherein each of said slotted openings extends more than half way along the length of said body portion.

11. A method for braiding hair using a hair braiding device, the method comprising the steps of:

parting all or a region of a person's hair into two sections;

grasping the hair braiding device with a first hand and placing the hair braiding device at a point on the person's head at which a braid is to begin;

inserting a first section of hair opposite the first hand into a first lined opening which is filled with a lining of malleable material so that the lining is compressed by the same area as that of the inserted hair thereby maintaining tension on the inserted hair;

grasping the hair braiding device with a second hand and inserting a second section of hair into a second lined opening of the device;

rotating the hair braiding device a defined number of times to roll the inserted sections of hair relative to one another.

12. The method of claim 11, further comprising after the first and second sections of hair are retained by the hair braiding device, adding more sections of hair after rotating the device, and repeating said grasping, said inserting, and said rotating steps.

13. The method of claim 11, further comprising inserting the hair braiding device into the braid to fix and retain the braid.

14. The method of claim 11, further comprising removing the hair braiding device after a desired length of braid is achieved and fixing and retaining the braid by a clasp or band.

* * * * *